US007925499B2

(12) United States Patent
Thomas

(10) Patent No.: US 7,925,499 B2
(45) Date of Patent: Apr. 12, 2011

(54) METHOD AND APPARATUS FOR PROCESSING A SPEECH SIGNAL

(75) Inventor: Kenneth Lee Thomas, Herts (GB)

(73) Assignee: Avaya Inc., Basking Ridge, NJ (US)

( * ) Notice: Subject to any disclaimer, the term of this patent is extended or adjusted under 35 U.S.C. 154(b) by 941 days.

(21) Appl. No.: 11/777,514

(22) Filed: Jul. 13, 2007

(65) Prior Publication Data

US 2008/0027712 A1 Jan. 31, 2008

(30) Foreign Application Priority Data

Jul. 27, 2006 (EP) ..... 06253945

(51) Int. Cl.
*G10L 21/00* (2006.01)

(52) U.S. Cl. ..... 704/201

(58) Field of Classification Search ..... 704/201
See application file for complete search history.

(56) References Cited

U.S. PATENT DOCUMENTS

| | | | |
|---|---|---|---|
| 4,461,025 | A | 7/1984 | Franklin |
| 5,864,793 | A | 1/1999 | Mesiwala et al. |
| 2002/0094091 | A1 | 7/2002 | Wu et al. |

FOREIGN PATENT DOCUMENTS

| | | |
|---|---|---|
| EP | 0311808 | 4/1989 |
| EP | 0663748 | 7/1995 |
| EP | 06253945 | 10/2006 |

OTHER PUBLICATIONS

Chiarizia, Brigitte, "EP Application No. 06253945.7 Office Action Jun. 9, 2008", , Publisher: EPO, Published in: EP.

*Primary Examiner* — Susan McFadden
(74) *Attorney, Agent, or Firm* — Joseph B. Ryan; Jason Paul DeMont; Wayne S. Breyer

(57) ABSTRACT

A method and apparatus for generating a control signal for processing a speech signal comprising the steps of: adjusting the signal relative to a threshold level; and responsive to detection of a falling edge of the signal, holding the signal level for a holding period. The technique further comprises 'slowing' each rising edge of the signal. The technique further comprises attenuating each falling edge of the signal. The steps are carried out on a signal representing the envelope of the speech signal.

12 Claims, 2 Drawing Sheets

METHOD AND APPARATUS FOR PROCESSING A SPEECH SIGNAL

PRIORITY CLAIM

The present application claims the priority of European Patent Application No. 06253945.7, filed on Jul. 27, 2006.

BACKGROUND TO THE INVENTION

1. Field of the Invention

The invention relates to signal processing, and particularly but not exclusively to the processing of speech signals in a teleconferencing system.

2. Description of the Related Art

In teleconferencing applications, it is known for a plurality of users to be interconnected by means of a teleconferencing switch, such that the users can talk to each other and listen to each other, typically from remote locations. A user typically connects to a teleconferencing system using a telephone handset apparatus, but other means such as a personal computer may be used.

When speaking, a user's voice is detected by a microphone of a suitable apparatus, such as a telephone handset, and the thus detected speech signal is provided as an input to a teleconferencing switch, and the speech then broadcast to all participants of the telephone conference.

Whilst a user's voice is detected by the microphone, the microphone also detects background noise. Such background noise may, for example, be noise within the speaker's immediate environment, such as office noises including fans and such like, or external noises such as traffic noise. Generally it is desirable to have some background noise to provide a level of 'comfort' to listeners in the telephone conference. It is desirable, nevertheless, to minimize background noise such that the listener in the teleconference does not hear 'noise dominated' speech. The elimination or minimization of noise is therefore a problem which needs to be addressed.

A speech signal delivered to the input of a teleconferencing switch also typically includes undesirable transients. Transients may become present in the speech signal due to, for example, switching taking place in the system as the speech signal is routed to the teleconferencing switch. Generally the transients can be considered to be electrical noise, and are manifested as spikes in the speech signal.

Transients could also be caused by audio sources, for example pens clicking on tables where a microphone may be situated, light switches being turned on/off, doors clicking shut etc.

These spikes caused by transients translate to sound heard by a listener in the teleconferencing system, and are also a problem which needs to be addressed.

The envelope of a speech signal provided to a teleconferencing switch generally comprises portions or segments of speech, which segments are defined by a rising edge and a falling edge. Where a speaker pauses, even only briefly, in speaking, this may be sufficient to define a separation between two speech segments. In a typical teleconferencing system, which may have only a simple threshold cutoff, such pause will result in the user's speech being cut-off during the pause, giving the impression that the speaker has finished. This is undesirable, as it does not provide a true listening experience for the listener, as the listener may not detect from the heard speech that this is simply a 'live' pause and the speaker is continuing. This does not provide a listener with a listening experience which approximates to being in the same room as the speaker. This is a further problem to be addressed.

In teleconferencing speech when a user finishes speaking there is typically an almost instantaneous cut-off of the speech signal from the speaker, which can appear abrupt to a listener. This does not provide a listener with a listening experience which would be similar to that of being in the same room as the speaker. This abrupt cut-off is a yet further problem to be addressed.

It is an aim of the invention to address one or more of the above-stated problems.

SUMMARY OF THE INVENTION

In accordance with one aspect of the invention there is provided a method of generating a control signal for processing a speech signal comprising the steps of: adjusting the signal relative to a threshold level; and responsive to detection of a falling edge of the signal, holding the signal level for a holding period.

The method preferably further comprises slowing each rising edge of the signal. Such 'slowing' may result in attenuation of a transient. The method preferably further comprises slowing each falling edge of the signal.

The slowing of the rising or falling edge may comprise delaying the rate of change of the rising or falling edge. The slowing of the rising or falling edges may comprise reducing the gradient of the rising or falling edge.

The threshold level is preferably variable. The holding period is preferably variable. The 'slowing' of the rising edge is preferably variable. The 'slowing' of the falling edge is preferably variable.

Said steps may be carried out on a signal representing the envelope of the speech signal.

The method may further comprise the initial step of detecting the envelope of the speech signal.

The step of adjusting the envelope signal may comprise removing a level corresponding to the threshold level from the signal.

The method may further comprise the step of applying the control signal to a control input of an amplifier for amplifying the speech signal.

The speech signal may be a signal of a teleconferencing system.

In a further aspect the invention provides a computer program product for storing computer program code adapted to carry out any method described herein.

In a still further aspect the invention provides a computer program code for carrying out any method described herein.

In another aspect the invention provides a speech processing apparatus for generating a control signal for processing a speech signal, comprising adjustment means for adjusting the signal relative to a threshold level; and holding means, responsive to detection of a falling edge of the signal, for holding the signal level for a holding period.

The speech processing apparatus may further comprise means for 'slowing' each rising edge of the signal. The speech processing apparatus may further comprise means for 'slowing' each falling edge of the signal.

A signal representing the envelope of the speech signal is preferably processed.

The speech processing may further comprise detection means for detecting the envelope of the speech signal.

The adjusting means may comprise removing means for removing a level corresponding to the threshold level from the signal.

The control signal may be for applying to a control input of an amplifier, the amplifier being arranged to amplify the speech signal.

A teleconferencing system may comprise a speech processing apparatus as described herein.

A switch of a teleconferencing apparatus may comprise a speech processing apparatus as described herein.

DESCRIPTION OF THE PREFERRED EMBODIMENTS

The invention is described by way of example, with reference to an example of the processing of a speech signal at an input to a teleconference switch. The invention is, however, not limited to such an example scenario, as will be apparent to one skilled in the art.

Figure 1:
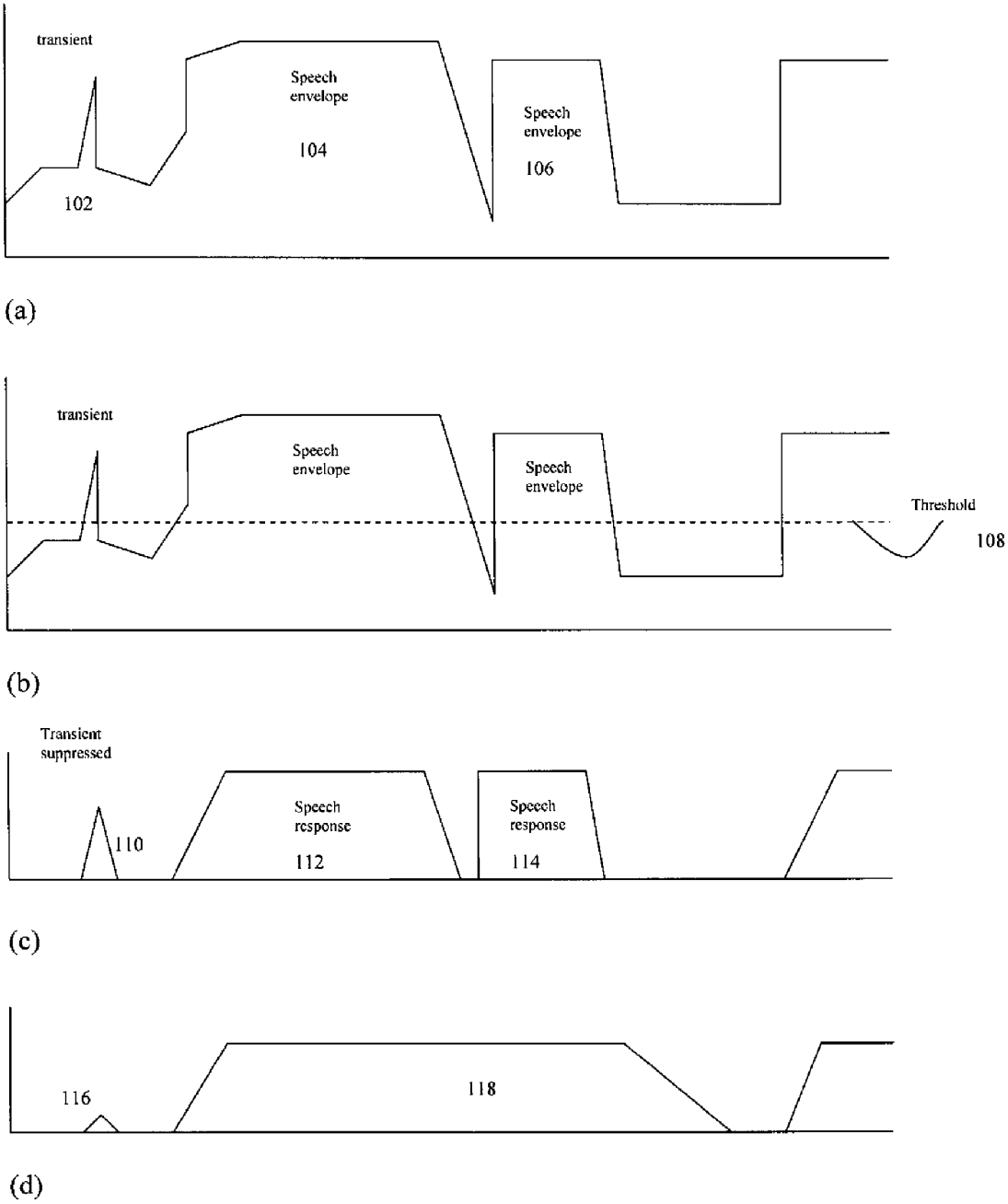
FIGS. 1(*a*) to 1(*d*) illustrate waveforms at various stages in the generation of a control signal in accordance with embodiments of the invention.

With reference to FIG. 1(*a*), there is shown an example of the envelope of a speech signal such as may form the input signal to a teleconferencing switch. The speech signal may be provided to the input of the teleconferencing switch from a microphone of a telephone handset, being used by a participant in a telephone conference.

The input speech signal has an envelope which represents user speech, background noise detected by the microphone, and transients, for example caused by switching. In FIG. 1(*a*) there is shown a transient 102, and two speech segments 104 and 106. The shape of the envelope is generally irregular, as a result of the speech/noise/transients contributing to the envelope at any instant.

Figure 2:
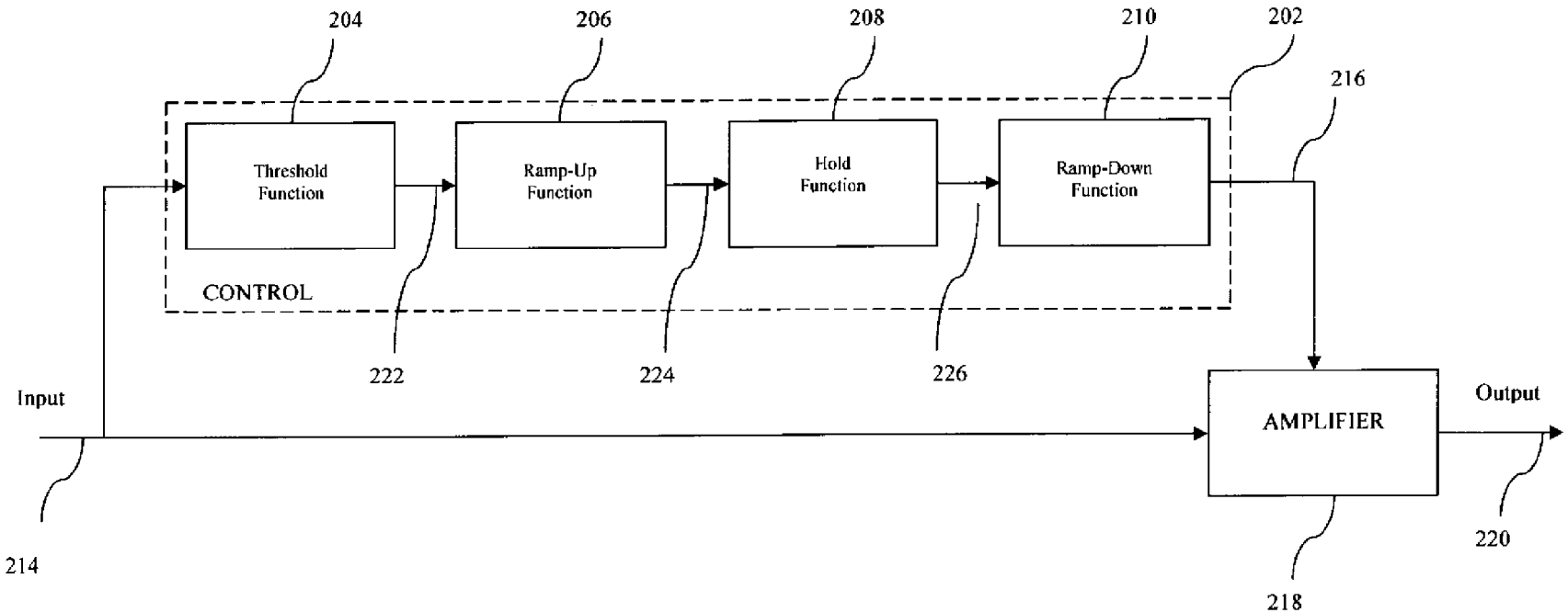
FIG. 2 illustrates the functional elements for generating a control signal in accordance with embodiments of the invention.

Referring to FIG. 2, the input speech signal illustrated in FIG. 1(*a*) is provided as an input signal on line 214 to an amplifier 218. The input speech signal on line 214 is also provided as an input to a control block 202. An output of the amplifier on line 220 provides an input to a teleconferencing switch.

The control block 202 of FIG. 2 includes, in accordance with a preferred implementation of the invention, a threshold functional block 204, a ramp-up functional block 206, a hold functional block 208, and a ramp-down functional block 210. The preferred operation of each of these functional blocks in accordance with embodiments of the invention is described hereinbelow.

The threshold functional block 204 receives the input signal, having the envelope shown in FIG. 1(*a*), on line 214. The threshold functional block, which may be implemented as a gating element, applies a threshold to the input signal in order to remove the information in the signal below the threshold level. The threshold level is implementation dependent, and may be varied. The threshold is generally chosen to be at a level at which useful speech is not provided. The purpose of applying the threshold is to remove unwanted background noise from the input signal.

Referring to FIG. 1(*b*), there is shown a threshold level 108 relative to the input signal of FIG. 1(*a*). Further referring to FIG. 1(*c*), there is shown the signal output from the threshold functional block 204 on a line 222 after application of the threshold. As can be seen from FIG. 1(*c*), the signal at the output of the threshold functional block corresponds to the signal at its input, as shown in FIG. 1(*a*), with the level equivalent to the threshold level removed there from.

The thus adjusted signal on line 222 is then provided as an input to the ramp-up functional block 206. The ramp-up functional block 206 'slows' any rising edge, or ramp-up, of the signal envelope. The 'slowing' causes the rise of the rising edges to be slowed. As such any rising edge is forced to rise more slowly than it would do otherwise. The purpose of the ramp-up functional block is to reduce or minimize the effect of any transients in the signal. Such transients are effectively attenuated. Referring to FIG. 1(*c*), the transient 110 is controlled by the ramp-up functional block such that the rising edge of the transient is attenuated. At the time the peak of the transient 110 of FIG. 1(*c*) is reached, the 'slowed up' rising edge is still rising, and has not reached this peak. Thus the transient starts to reduce at the point in time at which the peak of the transient 110 in FIG. 1(*c*) is reached. As a result the transient is reduced in size. The effect to the transient 110 of FIG. 1(*c*) by the ramp-up functional block can be seen by referring to the reduced transient 116 of FIG. 1(*d*). As is further discussed hereinbelow FIG. 1(*d*) illustrates the envelope of the signal at the output of the control block 202. However the transient 116 in this output signal is achieved directly by the ramp-up functional element operating on the transient 110.

The ramp-up signal also has the general effect of controlling the ramp-up or rising edge of all parts of the signal, including the rising edges of the speech portions of the signal 104 and 106.

The primary purpose of the ramp-up functional block is to 'slow' the rising edges of the envelope of the input signal such that transients, which are present for relatively short time periods, are reduced. The ramping up parameter, which controls the 'slowing', of the rising-edge functional block 206 may be varied, and is implementation dependent.

It can be seen the ramp-up functional block effectively slows the rising edges by reducing the gradient of such edges.

An output of the ramp-up functional block is provided on line 224 and forms an input to the hold functional block 208. The hold functional block 208 operates to delay the start of the falling edges of the signal envelope. That is, the hold functional block operates to hold the signal level, responsive to detection of a falling edge, for a predetermined delay period. If at the end of the delay period the signal is falling, then the delay functional block allows the signal to fall. If at the end of the delay period the signal is at its previous level, then an unnecessary glitch in the signal is avoided.

The purpose of the delay block can be best understood with reference to the waveforms of FIGS. 1(*a*) to 1(*d*). As seen in FIG. 1(*a*), there are shown two speech segments 104 and 106 which have a short gap there between. In practice, this short gap may be due to a slight pause in a speaker's voice, but does not necessarily means that a speaker has finished speaking and it may therefore be inappropriate to separate the segments as distinct passages of speech. Left as it is in FIG. 1(*a*), the speech pattern shown in FIG. 1(*a*) will appear to a listener as two distinct portions, with a 'cut-off' in between.

The delay functional block presents the speech signal from being cut-off where a short delay occurs between speech signals. The speech segment 112 of FIG. 1(*c*) is detected as ended by detection of a falling edge. The delay circuit then holds the envelope of the signal, as shown in FIG. 1(*d*), for a predetermined time before releasing it to follow the signal at the input thereto. When the gap is shorter than the delay, then the signal at the output of the delay is continuous between the two input segments 112 and 114, resulting in the continuous speech segment 118 of FIG. 1(*d*). This provides an improved listening experience to the listener, eliminating glitches in the signal input to the teleconferencing switch.

The hold functional block 208 thus provides a hysteresis to allow speech to be held for a fixed period responsive to detection of a falling edge. This makes speech seem continuous, and provides an improvement in voice quality, and an improved experience for the listener.

The delay parameter of the hold functional block 208 may be varied, and is implementation dependent.

The hold functional block 208 provides an output on line 226, which output forms an input to the ramp-down functional block 210. The ramp-down functional block 208 works in a similar way to the ramp-up functional block to 'slow down' or reduce the gradient of the falling-edges of the signal envelope. As such each falling edge is controlled to ramp down more slowly. This has the advantage of providing a signal envelope which does not terminate so abruptly, such that the listener experience is improved.

The attenuation parameter of the ramp-down functional block 210 may be varied, and is implementation dependent.

The ramp-down functional block provides an output on line 216, which forms an output of the control block 202. The output of the control block on line 216 forms the control signal which controls the amplifier.

The control signal supplied to the amplifier on line 216 is an envelope signal, generated as a result of the described four functional blocks being applied to the envelope of the signal which is to be amplified.

Thus, the control block in accordance with the preferred embodiment of the invention takes the envelope of the signal to be amplified, and then adjusts it in accordance with a threshold level; slows the rise of the rising edges thereof, applies a delay or hold to the points at which a falling edge is detected, and slows the fall of the falling edges thereof.

As can be seen from FIG. 2 the amplifier receives as an input the signal having an envelope as shown in FIG. 1(*a*), but being the full signal including the information portions thereof. The control envelope signal of FIG. 1(*d*) is applied to a control input of the amplifier 218, such that the amplifier provides a signal at its output on line 220 in accordance with the envelope on line 216. The output signal on line 220 is provided to a teleconferencing switch (not shown), and when a teleconference is in operation such signal represents the sound heard by listeners of the teleconference. Thus only information of the input signal on line 214 is provided on the output line 220 which falls within the window defined by the control envelope signal as applied to the amplifier.

The control block 202 preferably only requires at its input the envelope of the input signal on line 214; there is no requirement for the control block to receive the information contained in the signal. An envelope detector may be provided at the input to the threshold functional block 204 in embodiments. The amplifier 213 does, however, require the information in the signal at its input.

Each of the variables in the four functional blocks 204, 206, 208, 210, being a threshold variable, a ramp-up variable, a hold delay variable, and a ramp-down variable is independently adjustable.

As such, an improved signal is provided to the input of a teleconferencing switch. In practice a teleconferencing switch will receive multiple input signals, and the control technique described herein may be provided to each one.

The functional blocks shown in FIG. 2 may be implemented in hardware, firmware or software. Preferably the invention is implemented centrally, to the signals arriving at a teleconferencing switch. The invention may be implemented by software running on a digital signal processor associated with the teleconferencing switch.

The invention is not limited in its use to teleconferencing applications. The principles of the inventions, and embodiments thereof, may apply more generally to the processing of speech signals, particularly speech signals detected by a microphone. The invention may additionally have advantageous implementation outside of speech signaling, and may generally be applied in signal processing. The scope of protection afforded by the invention is defined by the appended claims.

The invention claimed is:

1. A method comprising:

generating, with a control block, a control signal based on an input signal that comprises a transient segment and a speech segment by:

(a) reducing an amplitude of the control signal by a threshold amount whenever the amplitude of the input signal exceeds the threshold amount; and (b) when a falling edge of the speech segment of the input signal is detected, holding the control signal level for a holding period; and amplifying, with an amplifier, the input signal to generate an output signal, wherein the amplification of the input signal is controlled by the control signal.

2. The method of claim 1 wherein the control signal is held level for a period when a falling edge of the input signal is detected.

3. The method of claim 1 wherein the control signal features a first rising edge that is generated by slowing a second rising edge in the input signal.

4. The method of claim 1 wherein the control signal is generated based on a signal representing an envelope of the input signal.

5. The method of claim 1 wherein the control signal features a first falling edge that is generated by slowing a second falling edge in the input signal.

6. The method of claim 1 wherein the output signal is provided to a switch.

7. The method of claim 1 wherein the output signal is provided to a teleconferencing system.

8. The method of claim 1 wherein the output signal features a first rising edge that is generated by slowing a second rising edge in the input signal.

9. The method of claim 1 wherein the output signal is generated based on a signal representing an envelope of the input signal.

10. A method comprising:

receiving an input signal that comprises:

(i) a transient segment and (ii) a speech segment; and generating an output signal based on the input signal by:

(a) reducing an amplitude of the output signal by a threshold amount whenever the amplitude of the input signal exceeds the threshold amount; and (b) when a falling edge of speech segment of the input signal is detected, holding the output signal level for a holding period; and wherein the output is provided to at least one of a switch or a teleconferencing system.

11. The method of claim 10 wherein the output signal is held level for a period when a falling edge of the input signal is detected.

12. The method of claim 10 wherein the output signal features a first falling edge that is generated by slowing a second falling edge in the input signal.

* * * * *